US006811378B2

(12) United States Patent
Kraft

(10) Patent No.: US 6,811,378 B2
(45) Date of Patent: Nov. 2, 2004

(54) INSULATED COOLING PASSAGEWAY FOR COOLING A SHROUD OF A TURBINE BLADE

(75) Inventor: Robert J. Kraft, Palm City, FL (US)

(73) Assignee: Power Systems Mfg, LLC, Jupiter, FL (US)

( * ) Notice: Subject to any disclaimer, the term of this patent is extended or adjusted under 35 U.S.C. 154(b) by 0 days.

(21) Appl. No.: 10/209,392

(22) Filed: Jul. 31, 2002

(65) Prior Publication Data

US 2004/0022633 A1 Feb. 5, 2004

(51) Int. Cl.[7] ..... F01D 5/22
(52) U.S. Cl. ..... 416/191; 416/97 R
(58) Field of Search ..... 416/191–2, 97 R, 416/96 R, 96 A, 95, 220 R, 97 A; 415/115, 116

(56) References Cited

U.S. PATENT DOCUMENTS 3,623,825 A * 11/1971 Schneider ..... 416/96
3,747,182 A * 7/1973 Hayes ..... 29/156.8 H
3,846,041 A * 11/1974 Albani ..... 416/97
5,259,730 A * 11/1993 Damlis et al. ..... 416/96 A
5,941,687 A * 8/1999 Tubbs ..... 416/97 R
6,099,253 A * 8/2000 Fukue et al. ..... 416/97 R
6,152,695 A * 11/2000 Fukue et al. ..... 416/97 R
6,193,465 B1 * 2/2001 Liotta et al. ..... 416/96 A

* cited by examiner

*Primary Examiner*—Edward K. Look
*Assistant Examiner*—James M. McAleenan
(74) *Attorney, Agent, or Firm*—Brian R. Mack

(57) ABSTRACT

A turbine blade is disclosed having a tip shroud that includes internal passages through which cooling air is flowed to minimize creep. The cooling air is provided to the shroud through dedicated cooling passageways which include tube inserts that restrict the transfer of heat from the airfoil portion of the turbine blade to the cooling air within the tube as the cooling air passes through the airfoil portion.

13 Claims, 5 Drawing Sheets

INSULATED COOLING PASSAGEWAY FOR COOLING A SHROUD OF A TURBINE BLADE

BACKGROUND OF THE INVENTION

The present invention relates to a blade for a gas turbine, and more specifically, to the cooling of a gas turbine blade shroud.

A gas turbine is typically comprised of a compressor section, a combustor section and a turbine section. The compressor section produces compressed air. Then fuel is mixed with some of the compressed air and burned in the combustor section. The compressed, high temperature gas produced in the combustor section is then expanded through rows of stationary vanes and rotating blades in the turbine section to produce power in the form of a rotating shaft.

Each of the rotating blades has an airfoil portion and a root portion that connects it to a rotor. Since the blades are exposed to the compressed, hot gas discharging from the combustor section, the turbine blades must be cooled to prevent failure. Usually this cooling is done by taking a portion of the compressed air produced by the compressor and using it as cooling air in the turbine section to cool turbine blades. The cooling air enters each cooled turbine blade through its root, and flows through radial passageways in the airfoil portion of the blades. While in many cooled turbine blades, the radial passageways discharge the cooling air radially outward at the blade tip, some turbine blades incorporate shrouds that project outwardly from the airfoil at the blade tip. These shrouds prevent hot gas leakage past the blade tips, and may also be used to dampen blade vibration that tends to occur during normal operation of gas turbine engines. Unfortunately, excessive creep and creep failures can occur in blade shrouds due to the high operating temperatures.

While the known methods of cooling turbine blades are generally successful at cooling the airfoil portions of turbine blades, designs for cooling shrouds have produced mixed results. In some designs, cooling air discharged from the radial passages at the blade tip flows over the radially outward facing surface of the shroud. Although this provides some cooling, it is often insufficient to adequately cool the shroud due to heating of the cooling air in the airfoil passageways.

Another design includes incorporating cooling passages into each shroud, with the cooling passages extending approximately parallel to the radially inward facing surface of the shroud. These passages, which connect to one or more of the radial passageways, divert cooling air from the airfoil passageways so that it flows through the cooling passages in the shroud, thereby lowering the operating temperature of the shroud. While this method of internally cooling the shroud is generally more effective than flowing cooling air over the radially outward facing surface of the shroud, the heat transfer rate from the shroud to the cooling air in the passages may be insufficient to prevent excessive creep at certain operating conditions.

What is needed is a turbine blade having a shroud that is sufficiently cooled to prevent excessive creep at all engine operating conditions.

SUMMARY AND OBJECTS OF THE INVENTION

It is therefore an object of the present invention to provide a turbine blade having a shroud that is sufficiently cooled at all engine operating conditions to prevent the excessive creep that can occur in turbine shrouds when turbine blades are exposed to high stress and very high operating temperatures.

According to the preferred embodiment of the present invention, a turbine blade is disclosed having a root portion with a cooling fluid cavity therein, a platform connected to the root portion, an airfoil portion extending from the platform, the airfoil portion includes at least one cooling passageway extending substantially radially through the airfoil, and at least one cooling hole extending substantially radially through the airfoil, with the one cooling passageway and the cooling hole each defined by an inner wall having an inlet for receiving a flow of cooling fluid from the cavity. The turbine blade further includes a shroud projecting outwardly from the airfoil and has a radially inward facing surface, a radially outward facing surface, and a shroud edge extending therebetween, at least one cooling fluid outlet adjacent the edge, and at least one cooling passage between the radially inward facing surface and the radially outward facing surface. The cooling passage is approximately parallel to the radially inward facing surface, and a tube is located within the cooling hole. The tube has an outer wall, a first end adjacent the inlet and a second end radially outward therefrom. The cooling passage communicates with the inlet through the tube, and standoff means between the inner wall of the cooling passageway and the outer wall of the tube maintain the inner wall of said cooling passageway in spaced relation to said outer wall of the tube to minimize heat transfer between the airfoil and the tube.

The above, and other objects, features and advantages of the present invention will become apparent from the following description read in conjunction with the accompanying drawings.

DETAILED DESCRIPTION OF THE PREFERRED EMBODIMENT

The present invention is relates to cooled turbine blades of the type used in gas turbine engines in which cooling air is supplied by the compressor of the gas turbine and is directed into the root of the cooled turbine blades through the rotors. These methods of getting the compressed air to the turbine blade roots will not be addressed in this description since these methods are well known in the art.

Figure 1:
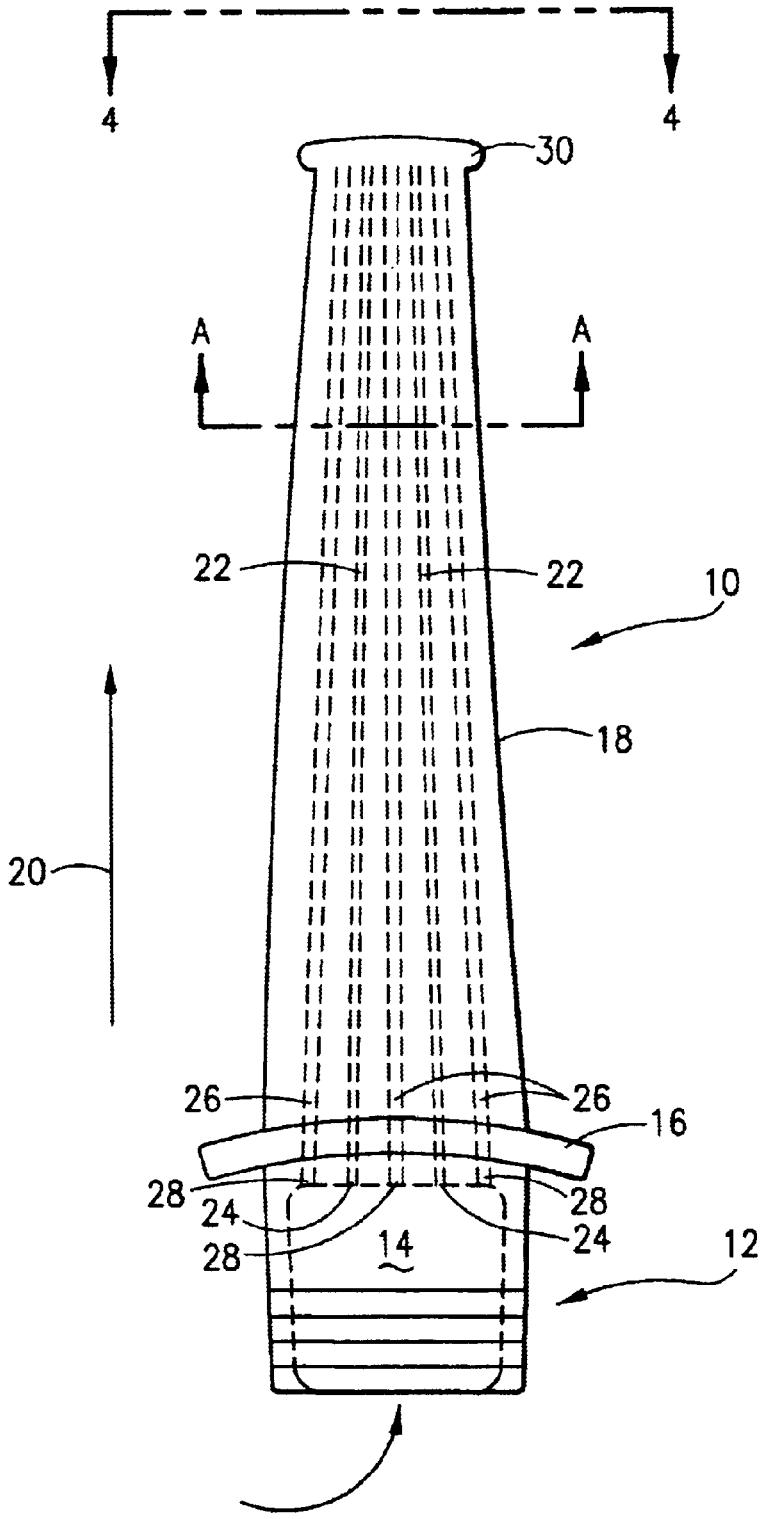
FIG. 1 shows a turbine blade of the present invention, with certain features shown in phantom lines.

As shown in FIG. 1, the turbine blade 10 of the present invention includes a root portion 12 having a cooling fluid cavity 14 therein. A platform 16 is connected to the root portion, and an airfoil portion 18 extends away from the platform 16 in a direction that is substantially parallel to a first radial direction 20. The airfoil portion 18 includes at least one, and preferably a plurality of cooling passageways 22 extending substantially radially through the airfoil portion 18. Each cooling passageway 22 has an inlet 24 for receiving a flow of cooling fluid from the cavity 14. In addition to the cooling passageways 22, the airfoil 18 preferably includes cooling holes 26 extending substantially radially through the airfoil portion 18. Each cooling hole 26 also has an inlet 28 for receiving a flow of cooling fluid from the cavity 14. A shroud 30 extends outwardly from the airfoil 18 adjacent the end of the airfoil 18 opposite the platform 16.

Figure 2:
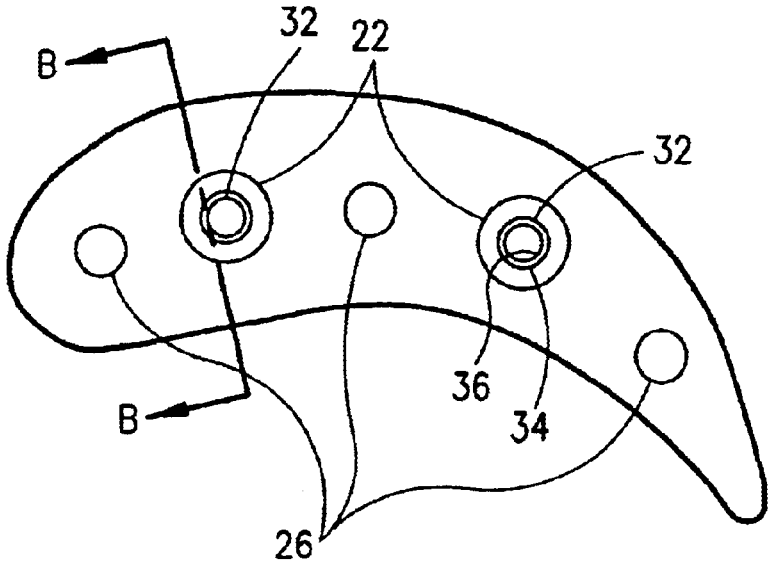
FIG. 2 shows a cross-sectional view of the airfoil portion of the present invention taken along line A—A of FIG. 1.

As shown in FIG. 2, a tube 32 is located within each cooling passageway 22. By contrast, the cooling holes 26 do not contain insulating tubes, since this would necessarily impair their ability to cool the airfoil portion 18 of the turbine blade 10. Each tube 32 has an outer wall 34 and an internal wall 36.

Figure 3:
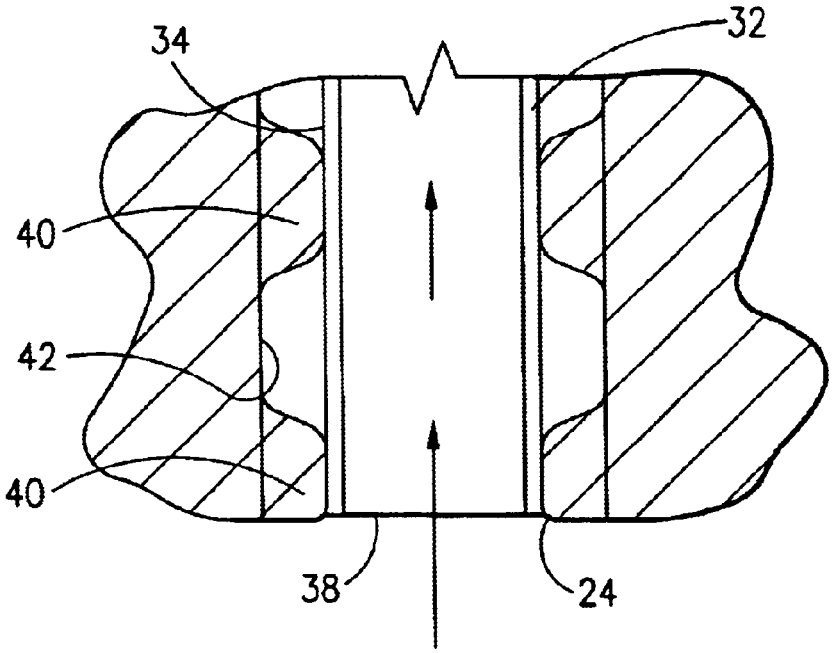
FIG. 3 shows a cross-sectional view of a cooling passageway and tube taken along line B—B of FIG. 2.

Referring now to FIG. 3, each insulating tube 32 has a first end 38 adjacent the inlet 24 of the passageway 22 in which it is located. In the preferred embodiment, standoff means extend from the inner wall 42 of the cooling passageway 22. The standoff means comprise at least one, and preferably a plurality of, protrusions 40 extending inwardly from the inner wall 42 of the passageway 22. Each protrusion 40 may be annular and therefore entirely encircle the tube 32, or each protrusion 40 may be nearly a localized "bump", which cooperates with other the other protrusions to maintain the relative position of the tube 32 in the cooling passageway 22. Each protrusion 40 contacts the outer wall 34 of the tube 32, thereby maintaining the inner wall 42 of the cooling passageway 22 in spaced relation to the outer wall 34 of the insulating tube 32. As those skilled in the art will readily appreciate, minimizing the contact area between the tube 32 and the inner wall 42 minimizes heat transfer between the airfoil portion 18 and the insulating tube 32.

Figure 4:
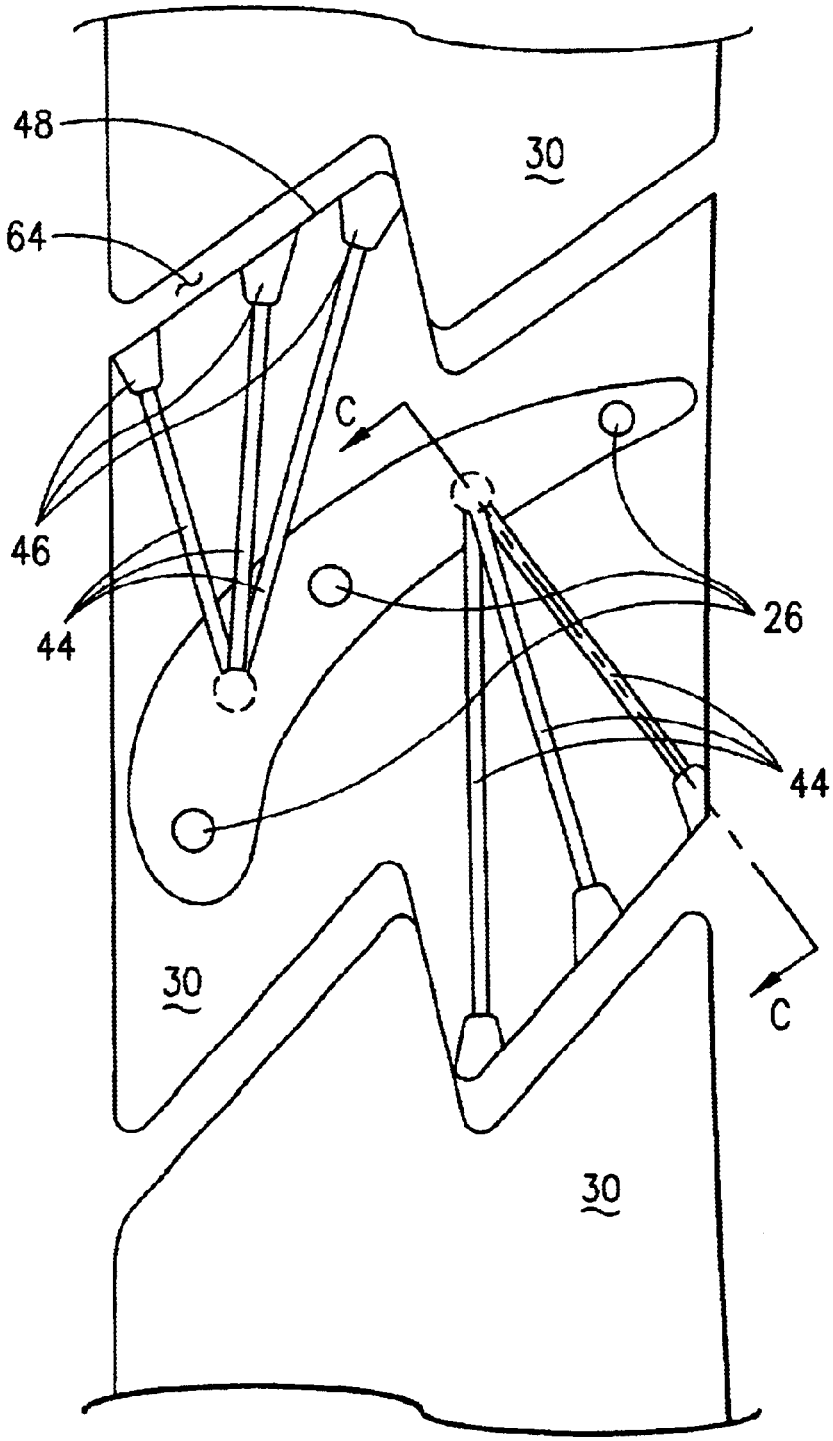
FIG. 4 is a plan view of the shroud of the present invention showing the cooling passageways, cooling passages, and cooling fluid outlets.
Figure 5:
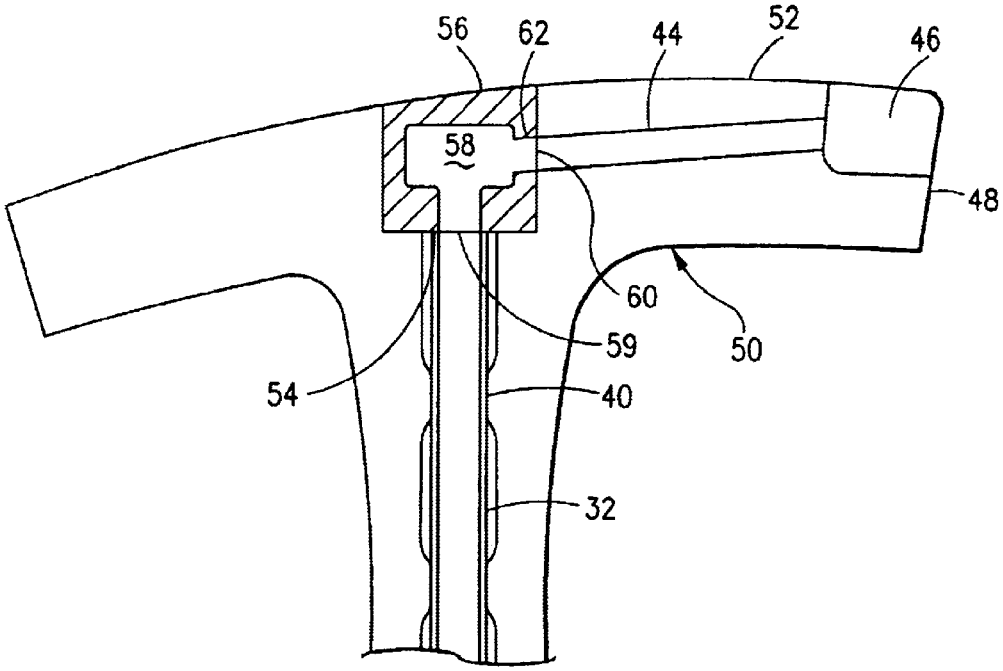
FIG. 5 shows a cross-sectional view of the shroud of the present invention taken along line C—C of FIG. 4.

As shown in FIG. 4, the shroud 30 preferably has a "Z-notch" configuration of the type known in the art. Each shroud 30 includes at least one, and preferably a plurality of cooling passages 44. Each cooling passage 44 has a cooling fluid outlet 46 adjacent an edge 48 that forms a portion of the Z-notch. Each cooling passage 44 communicates with an inlet 24 through one of the tubes 32. As shown in FIG. 5, each shroud 30 has a radially inward facing surface 50, a radially outward facing surface 52, and a shroud edge 48 extending therebetween. Each cooling passage 44 is located between the radially inward facing surface 50 and the radially outward facing surface 52. The cooling passages 44 are approximately parallel to the radially inward facing surface 50.

Each tube 32 has a second end 54 radially outward from the first end 38 thereof. The second end 54 abuts a tube retention plug 56. The tube retention plug 56 has an internal flowpath 58, including a flowpath inlet 59 and at least one flowpath outlet 60. The second end 54 of the tube 32 is preferably sealingly fixed to the tube retention plug 56 at the flowpath inlet 59. Each cooling passage 44 is in fluid communication with one of the tubes 32 through the internal flowpath 58 of one of a tube retention plug 56. The internal flowpath preferably includes metering means 62 for restricting fluid flow from the tube 32 to each cooling passage 44.

As shown in FIG. 4, the preferred embodiment of the present invention has at least two cooling passageways 22 and a plurality of cooling passages 44. Although the cooling fluid outlet 46 is shown in the radially outward facing surface 52 of FIG. 5, it is to be understood that the cooling fluid outlet 46 may be located in the shroud edge 48 if it is desirable to flow cooling fluid into the gap 64 between the shrouds of adjacent turbine blades 10. Likewise, if film cooling is desired along the edge 48 at the radially inward facing surface 50, the cooling fluid outlet 46 may be located in the radially inward facing surface 50 immediately adjacent the edge 48.

Figure 6:
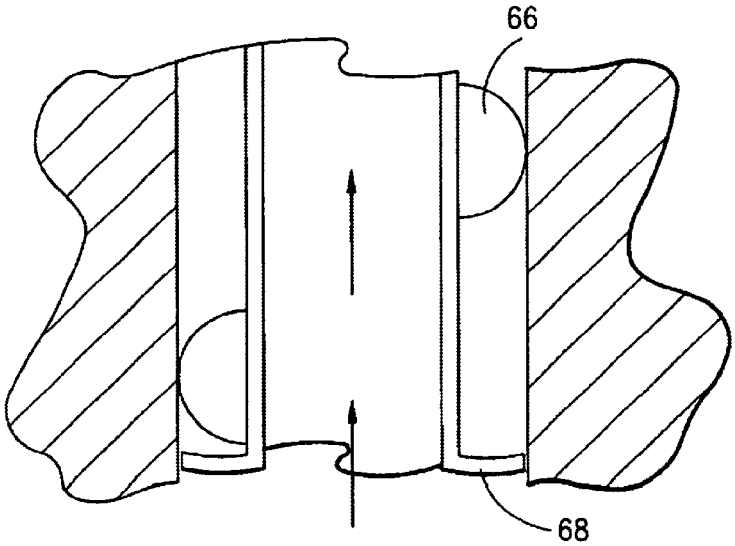
FIG. 6 is a cross-sectional view similar to FIG. 3, showing a first alternate embodiment of the present invention.

FIG. 6 shows a first alternate embodiment of the present invention, which is similar to the design of the preferred embodiment, except that the standoff means are different and a flange may be added to the cooling tube 32. In the first alternate embodiment, the inner wall 42 of the cooling passageway 22 is smooth, and at least one, and preferably a plurality of, protrusions 66 extend from the tube 32 and contact the inner wall 42 of the cooling passageway 22. As those skilled in the art will readily appreciate, the protrusions 66 maintain that tube 32 in spaced relation to the inner wall 42 of the cooling passageway 22, thereby minimizing heat transfer between the airfoil portion 18 and the tube 32. If the protrusions 66 are not annular, cooling air may be able to pass between the inner wall 42 of the cooling passageway 22 and the tube 32. Therefore, in the first alternate environment, it is preferable to provide an annular flange 68 at the inlet 24 to the cooling passageway 22 to direct the cooling air into the tube 32, and prevent cooling air from flowing between the inner wall 42 of the cooling passageway 22 and the tube 32.

Figure 7:
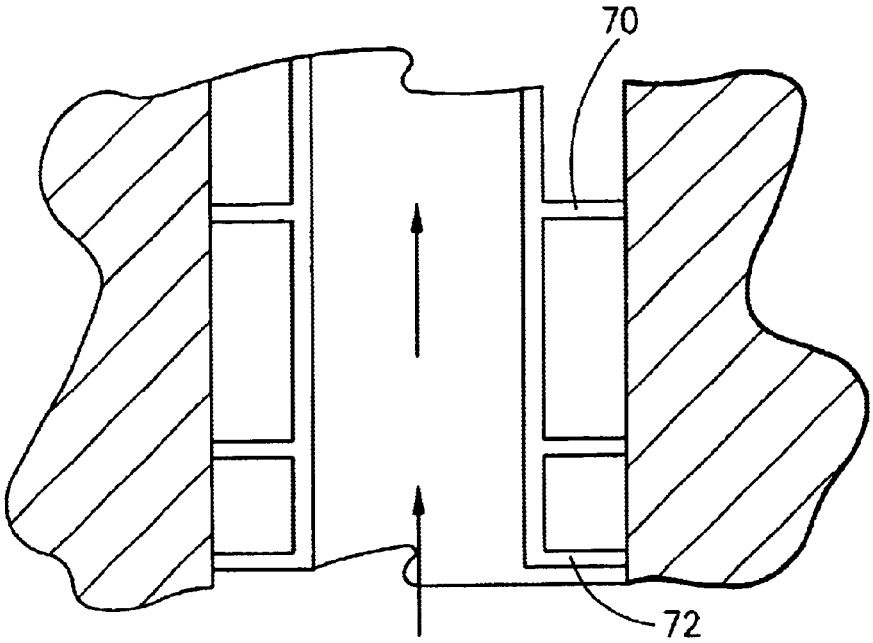
FIG. 7 is a cross-sectional view similar to FIG. 3, showing a second alternate embodiment of the present invention.

FIG. 7 shows a second alternate embodiment of the present invention, which likewise is similar to the design of the preferred embodiment except for the standoff means and the cooling tube flange. As in the first alternate embodiment, the inner wall 42 of the cooling passageway 22 is smooth, and at least one, and preferably a plurality of, protrusions 70 extend from the tube 32 and contact the inner wall 42 of the cooling passageway 22. In the second alternate embodiment, the protrusions 70 are preferably annular, so that each protrusion 70 acts to prevent the flow cooling air through the between the inner wall 42 of the cooling passageway 22 and the tube 32. The second alternate embodiment also preferably includes a flange 72 that performs the same functions as the flange 68 in the first alternate embodiment. However, since each protrusion 70 in the second alternate embodiment impedes the flow of cooling air between the inner wall 42 of passageway 22 and the tube 32, flange 72 is not as critical to the overall performance of the present invention. In fact, the flange 72 may be identical to the protrusions 70.

Although the preferred embodiments of the present invention have been described with reference to the accompanying drawings, it is to be understood that the invention is not limited to those precise embodiments, and that various changes and modifications may be effected therein by one skilled in the art without departing from the scope or spirit of the invention as defined in the appended claims.

I claim:

1. A turbine blade, comprising:

a root portion having a cooling fluid cavity therein;

a platform connected to said root portion;

an airfoil portion extending from said platform, said airfoil portion including at least one cooling passageway extending substantially radially through said airfoil, and at least one cooling hole extending substantially radially through said airfoil, said at least one cooling passageway and said at least one cooling hole each defined by an inner wall and having an inlet for receiving a flow of cooling fluid from said cavity;

a shroud projecting outwardly from said airfoil and having a radially inward facing surface, a radially outward facing surface, and a shroud edge extending therebetween, at least one cooling fluid outlet adjacent said edge, and at least one cooling passage between said radially inward facing surface and said radially outward facing surface, said at least one cooling passage approximately parallel to said radially inward facing surface;

a tube located within said cooling passageway, said tube having an outer wall, a first end adjacent said inlet and a second end radially outward therefrom, said cooling passage communicates with said inlet through said tube; and, standoff means for maintaining said inner wall of said cooling passageway in spaced relation to said outer wall of said tube to minimize heat transfer between the airfoil and the tube.

2. The turbine blade according to claim 1, wherein said standoff means comprise at least one protrusion extending inwardly from said inner wall of said passageway and contacting said outer wall of said tube.

3. The turbine blade according to claim 2, further comprising a tube retention plug, said plug having an internal flowpath, said internal flowpath including a flowpath inlet and at least one flowpath outlet, said second end of said tube is sealingly fixed to said plug at said flowpath inlet, and said at least one cooling passage is in fluid communication with said tube through said internal flowpath.

4. The turbine blade according to claim 3, wherein said internal flowpath includes metering means for restricting fluid flow from said tube to said at least one passage.

5. The turbine blade according to claim 4, wherein said at least one cooling fluid outlet is in said shroud edge.

6. The turbine blade according to claim 5, wherein said at least one cooling fluid outlet is in said radially inward facing surface.

7. The turbine blade according to claim 6, wherein said at least one cooling fluid outlet is in said radially outward facing surface.

8. The turbine blade according to claim 1, wherein said standoff means comprise at least one protrusion extending outwardly from said outer wall of said tube and contacting said inner wall of said passageway.

9. The turbine blade according to claim 8, further comprising a tube retention plug, said plug having an internal flowpath, said internal flowpath including a flowpath inlet and at least one flowpath outlet, said second end of said tube is sealingly fixed to said plug at said flowpath inlet, and said at least one cooling passage is in fluid communication with said tube through said internal flowpath.

10. The turbine blade according to claim 9, wherein said internal flowpath includes metering means for restricting fluid flow from said tube to said at least one passage.

11. The turbine blade according to claim 10, wherein said at least one cooling fluid outlet is in said shroud edge.

12. The turbine blade according to claim 11, wherein said at least one cooling fluid outlet is in said radially inward facing surface.

13. The turbine blade according to claim 12, wherein said at least one cooling fluid outlet is in said radially outward facing surface.

* * * * *